US010774522B1

(12) United States Patent
Bradford

(10) Patent No.: US 10,774,522 B1
(45) Date of Patent: Sep. 15, 2020

(54) APPARATUS AND METHOD FOR SAFELY SHORING HORIZONTAL WIND GIRTS DURING BUILDING CONSTRUCTION

(71) Applicant: Jared Bill Bradford, Visalia, CA (US)

(72) Inventor: Jared Bill Bradford, Visalia, CA (US)

( * ) Notice: Subject to any disclaimer, the term of this patent is extended or adjusted under 35 U.S.C. 154(b) by 0 days.

(21) Appl. No.: 16/231,475

(22) Filed: Dec. 22, 2018

Related U.S. Application Data

(63) Continuation-in-part of application No. 16/057,760, filed on Aug. 7, 2018, now Pat. No. 10,465,393.

(60) Provisional application No. 62/612,431, filed on Dec. 30, 2017, provisional application No. 62/612,584, filed on Dec. 31, 2017.

(51) Int. Cl.
*E04B 2/30* (2006.01)
*E04B 1/35* (2006.01)

(52) U.S. Cl.
CPC .... *E04B 1/3544* (2013.01); *E04B 2001/3588* (2013.01)

(58) Field of Classification Search
None
See application file for complete search history.

(56) References Cited

U.S. PATENT DOCUMENTS 202,197 A * 4/1878 Sherman ..... B66F 3/08 254/98
211,891 A * 2/1879 Dinsmore ..... B66F 3/08 254/98
270,012 A * 1/1883 Burruss ..... B66F 1/02 254/106
502,397 A * 8/1893 Emons ..... B66F 15/00 254/114
676,977 A * 6/1901 Bredehoft ..... B66F 15/00 254/114
775,347 A * 11/1904 Denton ..... B66F 15/00 254/114
841,078 A * 1/1907 Egan ..... B66F 15/00 254/114
1,405,875 A * 2/1922 Strange ..... A43D 5/02 12/123
1,462,878 A * 7/1923 Williamson ..... B66F 1/02 254/106
1,698,687 A * 1/1929 Beghetti ..... B66F 15/00 254/114
3,131,928 A * 5/1964 Whipple ..... B25H 1/00 269/224

(Continued)

*Primary Examiner* — Basil S Katcheves
(74) *Attorney, Agent, or Firm* — Richard A. Ryan

(57) ABSTRACT

A girt alignment apparatus and a method of using the apparatus to shore wind girts of a building to level and support the wind girts to install panels and/or panelized sections to form a wall. The apparatus has an elongated support pipe, a base assembly at a lower end of the support pipe that supports the support pipe in an upright position, a lever assembly connected to the support pipe to move the support pipe upward and downward and one or more girt support assemblies attached to and extending outward from the support pipe to engage the wind girt. In use, the apparatus is placed next to a span having wind girts with the lever assembly in a retracted position. The lever assembly is moved to an extended position to move the support pipe and girt support assemblies upward to engage, level and support the wind girts.

17 Claims, 8 Drawing Sheets

(56) References Cited

U.S. PATENT DOCUMENTS

| | | | | | |
|---|---|---|---|---|---|
| 3,930,645 | A * | 1/1976 | Anderson | B25J 1/04 | 269/289 R |
| 4,482,130 | A * | 11/1984 | Paredes | B66F 15/00 | 254/8 R |
| 5,135,200 | A * | 8/1992 | Neibrandt | B66F 15/00 | 254/114 |
| 5,199,687 | A * | 4/1993 | Maurer | B66F 15/00 | 254/114 |
| 6,302,378 | B1 * | 10/2001 | Koch | B66F 15/00 | 254/131 |
| 6,330,894 | B1 * | 12/2001 | Austin | B25B 5/003 | 144/256.1 |
| 7,387,293 | B2 * | 6/2008 | Boucher | E04F 21/1894 | 254/120 |
| D592,822 | S * | 5/2009 | Boucher | D34/31 | |
| 2001/0029715 | A1 * | 10/2001 | Bradley | E04F 21/18 | 52/344 |
| 2002/0159863 | A1 * | 10/2002 | Ray | B66F 11/044 | 414/11 |

* cited by examiner

APPARATUS AND METHOD FOR SAFELY SHORING HORIZONTAL WIND GIRTS DURING BUILDING CONSTRUCTION

CROSS-REFERENCE TO RELATED APPLICATIONS

This patent application claims priority to U.S. Provisional Patent Application No. 62/612,431 filed Dec. 30, 2017 and to U.S. patent application Ser. No. 16/057,760 filed Aug. 7, 2018, which claimed priority to U.S. Provisional Patent Application No. 62/612,584 filed Dec. 31, 2017.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The present invention relates generally to apparatuses, systems and methods that are configured to efficiently, safely and quickly install wall panels onto the walls of a building or like structure. Specifically, the present invention relates to such apparatuses, systems and methods that aid construction workers with shoring and leveling horizontal wind girts to allow the workers to more efficiently and safely install wall panels onto the walls of the structure for use as cladding thereon. More specifically, the present invention relates to such apparatuses, systems and methods that allow the users to quickly, accurately and safely position and support horizontal wind girts during construction of a metal building without the risk of dunnage or other support material falling on the workers.

B. Background

Metal cladding, which is the exterior wall and roof material installed on pre-engineered metal or steel buildings, is generally grouped into three categories, namely, exposed fastener panels, concealed fastener panels and standing seam. Metal cladding is typically machine formed through the use of roll-formers, sheet metal brakes or sheet metal folders from large coils of pre-coated sheet metal, typically ranging in thicknesses of 18 to 29 gauge, to construct the finished or installed shape of the metal panels, which typically range in width between two and four feet and may be of a wide rage of widths, with some panels be as long as forty feet or more. The typical, mechanical manufacturing method, which has been in use for several decades, produces a standardized appearance and profile for the metal panels. As a result, there are several primary styles of panels that are sold by the primary or core group of metal building manufacturers in the United States and globally. While metal panels may have different profiles, nearly all of the different styles of panels are corrugated, meaning they comprise a series of ribs and valleys (also referred to as pans and flutes) between the ribs, and they are configured to provide the structural integrity that is necessary to resist loads which are imposed on the building, weatherproof the building envelope and provide an aesthetic appeal for the structure. The corrugations of a metal panel are designed to interlock or "corrugate" with each other, for a particular style of metal panel, to provide a continuous, repeatable and predictable pattern on the surface of the wall or roof of the building.

The typical method that is utilized to install exterior metal cladding on a building is generally accomplished with a crew of three to five workers who install the metal panels from a position on the ground. The panels are received at the job site in stored bundles that usually comprise thirty to forty panels per bundle, with the panels in the bundle being prepared or pre-drilled. A metal panel is removed from the bundle of panels and carried by hand to the leading edge of the wall or roof structure. The metal panel is lifted into place using a tethered clamp or by lifting the panels progressively vertical at an interval that is determined by the width of a single manufactured metal panel. After positioning the panel on the wall or roof surface, the metal panel is checked for vertical and/or horizontal alignment, measured for squareness and then secured to the building's superstructure, which comprises a plurality of rigid frame members and girts or purlins between the frame members, by screws or other mechanical fasteners that connect the wall or roof panels to the frame members, girts or purlins. The metal cladding for a structure typically comprises manufactured metal panels installed over a thermal blanket insulation with laminated scrim or vinyl facing, or with a variety of other materials, such as gypsum wall board, exterior sheathing or the like.

As well known by persons who are skilled in the relevant art, the present apparatuses, systems and methods of installing panels, particularly metal panels on the superstructure of a metal framed building, is known to be time consuming and inherently subject to errors with regard to the positioning and alignment of the panels. In particular, if the panels are not carefully positioned, the finished wall of panels can lack uniformity with regard to overhang distances and not have the desired squareness, which can result in saw-tooth panel edges on the squarely framed superstructure. In addition, the resulting wall or roof can have openings where the apertures in a panel were not aligned with the metal frame, girt or purlin to which the panel is attached.

Based on the consistency of the general configuration of the metal panels, from one style of panel to another, various types of tools and equipment have been developed for use to assist the workers with handling and installing the metal cladding on the superstructure of a structure. For instance, U.S. patent application Ser. No. 16/057,760 to Bradford (the present inventor), the disclosure of which is incorporated herein, describes a new apparatus, system and method of combining a plurality of panels into a fixed group of panels or a panelized section, a process that is referred to as panelizing, that can then be easily, safely and efficiently attached to the frame of a building to form the building's wall or roof cladding. The apparatus, system and method described in the above-identified patent application allows the user to quickly install wall and roof panels on a building, such as a metal framed building, in a manner which is much safer and more efficient than present systems and methods of installing panels on the frame of a building. The invention described in the subject patent application has two primary working assemblies with varying attachments, options, and appurtenances that are utilized to aid in the assembly and installation of exterior cladding. One working assembly is generally configured as a layout table or jig, referred to as the panelizing assembly, having a support frame, alignment structure, rail tracks and a rolling cart. The other working assembly is a lifting assembly that is placed against the panelized section while it is on the panelizing assembly, attached to the panelized section and then utilized to raise the panelized section into place so it may be attached to the wall or roof structure.

As well known, a standard metal building superstructure comprises a plurality of rigid frames, referred to as post and beam frames, with a plurality of horizontal girts that span between adjacent post frames in the walls and a plurality of horizontal purlins that span between adjacent beam frames in the roof. In preparation for installing the metal panels, the installer must prop up the girt at or near the mid-span region of the girt between a pair of rigid frames to compensate for the natural sag of the unsupported girt. Ensuring that a girt is at its proper height along its entire length is required so the screws for the exterior wall panel, whether as an individual panel or as a panelized section, will directly land on, and thereby be attached to, the girt in a manner which will result in the metal cladding having a clean and even appearance.

Currently, the standard method used to prop horizontal girts up to the correct elevation between a pair of rigid frames is to utilize wood dunnage that are cut to a specified length and then wedged into place mid-span between adjacent girts moving upward from the foundation level to the highest girt. When installing the exterior wall panels, the installer must use a scissor lift, man basket or ladder to remove the wood dunnage, piece by piece, from top to bottom. The installer then moves the equipment to the next shoring location and wedges the wood dunnage into place, piece by piece, from the bottom to the top in order to continue installing the exterior wall panels. As well known to persons who are skilled in the relevant art, in addition to being time consuming, this age-old method of shoring the girts is dangerous. Because there are no mechanical fasteners or clamps holding the wood dunnage in place, the pieces of wood will randomly become dislodged and fall toward the ground, possibly injuring workers or other persons who are standing or working below. The United States occupational safety and health administration (OSHA) considers being struck by falling objects among the "fatal four" leading causes of construction accident deaths.

What is needed, therefore, is a new apparatus and method of using the apparatus that will provide a safer and more productive and efficient alternative to shoring one or more horizontal frame members at the correct elevation between a pair of vertically disposed frame members. Specifically, what is needed is a new apparatus and method of using the apparatus to shore horizontal wind girts that are configured to easily, quickly and safely position the wind girts between vertical frame members, such as posts, without the need to use dunnage (whether made out of wood or other material) to eliminate the possibility of dunnage falling from the framed wall and injuring workers and other persons who may be working or otherwise located below the wind girts and allow construction to move forward at a safer and more rapid pace. The new apparatus and method of using the new apparatus should be configured to be utilized with most metal buildings and how erectors and other persons in the industry commonly work. The new apparatus should also be configured to allow for different job site conditions, including being able to be utilized clear of previously installed formed base trim, base angle with trim and the like that are commonly required for wall panel installation. The new apparatus should also be configured for use in interior applications in a manner that allows the apparatus to clear buildings that have interior curbing, wainscot materials or other obstructions. The new apparatus and method of using the apparatus should also be configured to accommodate different building eave heights. Preferably, the new apparatus should be easy to use and relatively inexpensive to manufacture.

SUMMARY OF THE INVENTION

The apparatus and method for shoring horizontal wind girts during building construction of the present invention provides the benefits and solves the problems that are identified above. That is to say, the present invention discloses a new apparatus and method of using the apparatus that aids construction workers with shoring and leveling horizontal wind girts that are utilized for metal buildings and other structures. In one embodiment of the present invention, the apparatus and method is utilized to quickly, efficiently and safely prepare the wind girts for installation of wall panels, either individually or as a panelized section, onto the superstructure of the building. The new apparatus generally comprises a vertically disposed elongated mast, pole or other uprightly disposed support pipe having a base assembly at the lower end thereof, a lever assembly, such as a jack lever or the like, that interconnects the support pipe and the base assembly, and at least one girt support assembly attached to the support pipe at the intended height of a wind girt. Typically, there will be a plurality of girt support assemblies attached to the support pipe. When the jack lever is placed in its fully extended position, the support pipe is moved vertically upwards so the girt support assemblies will raise the sagging wind girts to their proper, level elevation so that a wall panel, panelized section or other wall member can be attached to the wind girt. As will be readily appreciated by persons who are skilled in the relevant art, the new girt alignment apparatus and method of use thereof provides a much safer and more efficient alternative to shore the wind girts at their correct elevations than use of the prior art dunnage that is described in the Background. The new girt alignment apparatus and method of using the apparatus of the present invention completely eliminates the possibility of a piece of dunnage falling from the building frame, which could injure workers and others located below the wind girts. The new apparatus and method of using the apparatus allows the user to quickly disconnect, reposition and reconnect the girt alignment apparatus from one span between posts to another span. The new girt alignment apparatus has a continuous clamp wedge design and a safety restraint that allows metal and other panels to be installed at a more rapid, but safer, pace.

The new girt alignment apparatus and method of the present invention is adaptable to accommodate a majority of metal buildings and other structures and how erectors and other persons commonly work. In one embodiment, the telescoping pipe, which can be tubular, of the apparatus is designed to be utilized accommodate buildings with exterior walls having eave heights from ten feet to over thirty-five feet above the ground. The lever assembly of the apparatus has sufficient leverage to be utilized with minimum force from the operator, either foot or hand pressure, and is located at a height that is comfortable for either use. The new apparatus has a safety chain connected at the upper end of the apparatus. The safety chain has a clasp or like attachment device that is utilized to secure the apparatus to the superstructure by wrapping the chain around a framing member or to a piece of aerial equipment for relocation to the next wind girt shoring location (i.e., to another span between posts). The new girt alignment apparatus can be supplied with multiple girt support assemblies, which clamp onto the support pipe, for use with metal buildings that may be designed with firewalls or multiple girts for high wind locations. In a preferred configuration, the girt support assemblies are fully adjustable on the support pipe to allow the installers to choose the spacing for the wind girts and are designed at a minimum overall height to prevent clearance issues in tight wind girt locations, such as when blocking for exterior panels below eave canopies, header framing and the like.

The new girt alignment apparatus of the present invention is structured and arranged to be adaptable so as to be able to be utilized with any manufactured shape or style wind girt that are typically or commonly utilized in metal building construction. Preferably, the girt support assemblies are sized and configured to provide clearance for use with different sized flanges, webs and profiles of the horizontal framing members (such as wind girts). Specifically, whether the wind girt is a "C" or "Z" roll formed profile of any of the full array of available sizes, the girt support assemblies of the new apparatus will accommodate any size or shape of wind girt, even if the girt is toe down or toe up, within any width. The girt support assemblies are configured to hold the wind girt at the correct elevation and flat (i.e., without the wind girt being twisted). Preferably, the base assembly of the new apparatus has one or more curved shaft members that interconnect the lower end of the support pipe to a footplate. The curved shaft members provide an off-set section of the base assembly to allow the new apparatus to accommodate different job site conditions, including job sites having previously installed formed base trim, base angle with trim and the like that are required for wall panel installation. For interior applications that have interior curbing, wainscot materials or other obstructions, the footplate and shaft members of the base assembly may be rotated 180 degrees to clear such obstructions. In the preferred configurations, the support pipe of the new apparatus is telescopically configured, with at least a first pipe member and a second pipe member, so as to be adjustable in height for use with different eave heights. One or more clamps are configured to engage the pipe members and are utilized to rigidly secure the support pipe when it is fully extended. As set forth above, the safety chain is utilized to secure the new girt alignment apparatus to the structure's frame and for use when the installer prefers to chain the apparatus to a basket or other component of the aerial equipment that is utilized to move the girt alignment apparatus to the next shoring location (i.e., to another span between posts).

In one embodiment of the present invention, the new apparatus for shoring horizontal wind girts generally comprises a vertical positioned support pipe, a base assembly at a lower end of the support pipe, a lever assembly operatively connected to the support pipe and a girt support assembly having a bracket that is attached to or integrally formed with the support pipe. The support pipe has an elongated pipe body that defines an upper end and lower end of the support pipe and a pipe axis through the support pipe between the lower end and the upper end thereof. The base assembly is structured and arranged to support the support pipe in an upright position on a support surface that is at or adjacent a span between the posts of a frame of a building. The lever assembly is configured to move the support pipe upward when the lever assembly is moved to an extended position and to move the support pipe downward when the lever assembly is moved to a retracted position. The girt support assembly moves upward and downward with the support pipe in response to the operation of the lever assembly. The bracket of the girt support assembly extends outward from the support pipe and is positioned on the support pipe to engage the wind girt when the lever assembly is moved to the extended position so as to move the wind girt from a sagging condition, which is normal for unsupported wind girts due to their own weight, to a level condition that will make it faster, easier and safer to attach wall panels or panelized sections to the wind girt. In a preferred embodiment, the support pipe comprises two or more pipe members and a length adjusting mechanism that is cooperatively configured with the two or more pipe members for adjusting the length (i.e., vertical height) of the support pipe. In one configuration, the two or more pipe members are telescopically configured and the clamping mechanism comprises one or more clamping devices that are configured to fix the length (height) of the support pipe. In one of the preferred configurations, the apparatus also has safety chain that is sized and configured to engage the frame of the building to prevent the apparatus from falling and/or to be engaged by an aerial lifting machine to allow the user to more easily move the apparatus to a different span or other location.

To support the apparatus on the support surface, the base assembly comprises a footplate that is pressed downward against the support surface when the girt support assembly presses upward against the wind girt. Preferably, the base assembly further comprises one or more curved shaft members and an inner shaft member, with the one or more shaft members being disposed between the footplate and the lower end of the support pipe and the inner shaft member being positioned above the one or more shaft members and disposed inside the lower end of the support pipe to allow the support pipe to move upward and downward relative to the base assembly.

In preferred embodiments of the new apparatus, the lever assembly interconnects the support pipe and the base assembly to move the support pipe upward when the lever assembly is moved to the extended position and downward when the lever assembly is moved to the retracted position. In one configuration, the lever assembly connects to one or more lever mounts that are attached to or integral with the support pipe and to one or more lever mounts that are attached to or integral with the base assembly. The lever assembly can comprise one or more upper lever members that are pivotally connected to the support pipe and one or more lower lever members that are pivotally connected to the base assembly. In this configuration, the upper lever members and the lower lever members are pivotally connected to each other to allow the lever assembly to move between the retracted position and the extended position.

In the preferred embodiments of the present invention, the girt support assembly comprises a pipe attachment mechanism for moveably attaching the bracket to the support pipe to allow the user to adjust the vertical position of the bracket on the support pipe. In one configuration, the girt support assembly has a girt contact plate, an engaging bracket and an engaging member, with the girt contact plate being sized and configured engage the wind girt and the engaging bracket and the engaging member being cooperatively configured to secure the girt support assembly to the support pipe.

In another embodiment of the present invention, the new method for shoring horizontal wind girts generally comprises the steps of: (1) providing a girt alignment apparatus having a telescopically configured elongated support pipe with a lower end and an upper end, a base assembly at the lower end of the support pipe, a lever assembly operatively interconnecting the support pipe and the base assembly so as to move the support pipe upward and downward, and a girt support assembly moveably secured to the support pipe to move upward and downward with the support pipe, with the girt support assembly being configured to extend outwardly from the support pipe to engage the wind girt to move the wind girt from a sagging condition to a level condition; (2) adjusting the support pipe to have sufficient height to extend the upper end thereof upward to at or above the wind girt and securing the girt support assembly on the support pipe at a position thereon so the girt support assembly will be below the wind girt in the sagging condition when the lever assembly is in a retracted position and will engage the wind girt when the lever assembly is in an extended position; (3) standing the apparatus in an upright position at the span with the base assembly on a support surface and the girt support assembly positioned below the wind girt in the sagging condition with the lever assembly being in the retracted position; and (4) moving the lever assembly to the extended position to raise the support pipe and the girt support assembly upward to engage the wind girt and move the wind girt to the level condition. In the preferred configuration, the apparatus has a safety chain and the method further comprises the step of securing the safety chain to the frame of the building prior to the lever assembly moving step and/or the step of moving the apparatus away from the span with the safety chain after the moving step. In use, the method further comprises the step of attaching a plurality of panels and/or one or more panelized sections of panels to the wind girts to form a wall of a building and operating the lever assembly to place the lever assembly in the retracted position to move the support pipe and the girt support assembly downward to disengage from the wind girt after the lever assembly moving step.

Accordingly, the primary objective of the present invention is to provide an improved apparatus and method for safely shoring horizontal wind girts that has the benefits that are described above and elsewhere herein and which overcomes the various limitations and problems that are associated with currently available apparatuses and methods for shoring horizontal wind girts for the frame of a metal building or other structure.

It is also a primary objective of the present invention to provide an improved girt alignment apparatus and method of using the apparatus that allows the user to more accurately, efficiently and safely shore horizontal wind girts disposed between posts of a building frame.

An important aspect of the present invention is that it provides a new apparatus and method for aligning and shoring wind girts that achieves the goals of the above-described objectives.

Another important aspect of the present invention is that it provides an improved girt alignment apparatus and method of using such apparatus to aid the user thereof to more accurately, efficiently and safely level the horizontal wind girts between posts of a building frame.

Another important aspect of the present invention is that it provides an improved girt alignment apparatus and method of using such apparatus to aid the user thereof to more accurately, efficiently and safely position the horizontal wind girts between posts of the superstructure of a metal building to prepare the wind girts for installation of wall panels, whether individual panels or panelized sections of panels, or other wall members that form the walls the building.

It is also an important aspect of the present invention to provide an improved girt alignment apparatus and method of using such apparatus that comprises a vertically disposed support pipe having a lever assembly operatively attached to the support pipe and a base assembly, which rests on the floor or other surface, and a plurality of girt support assemblies which are moveably positioned on the support pipe at the intended height of each wind girt in order to prevent the wind girts from sagging between posts so the wind girts will be level and at the desired position for attaching a plurality of wall panels, or a panelized section of wall panels, to the frame of a building in a manner that is much safer than prior art use of dunnage and the like, which are known to create falling hazards.

Yet another important aspect of the present invention is that it provides an improved girt alignment apparatus for positioning and maintaining the correct level position of the wind girts of the frame of a building that is easy to use and relatively inexpensive to manufacture.

As will be explained in greater detail by reference to the attached figures and the description of the preferred embodiments which follows, the above and other objects and aspects are accomplished or provided by the present invention. As set forth herein and will be readily appreciated by those skilled in the art, the present invention resides in the novel features of form, construction, mode of operation and combination of processes presently described and understood by the claims. The description of the invention which follows is presented for purposes of illustrating one or more of the preferred embodiments of the present invention and is not intended to be exhaustive or limiting of the invention. As will be readily understood and appreciated, the scope of the invention is only limited by the claims which follow after the discussion.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth in the text below. The enclosed figures are illustrative of one or more potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show particular materials, shapes and configurations for the various components of the new girt alignment apparatus and method of the present invention and panels or panelized sections and buildings with which the apparatuses and method may be utilized therewith, persons who are skilled in the art will readily appreciate that the present invention is not so limited. In addition, the exemplary embodiments of the present apparatus and method are shown and described with only the components which are required to disclose the present invention. It may be that some of the necessary elements for manufacturing, attaching and using the present invention are not shown or are not necessarily described below, but which are well known to persons skilled in the relevant art. As will be readily appreciated by such persons, the various elements of the present invention that are described below may take on any form consistent with forms that are readily realized by persons of ordinary skill in the art having knowledge of panels/panelized sections and buildings and other structures which use or can utilize such panels/panelized sections.

Figure 6:
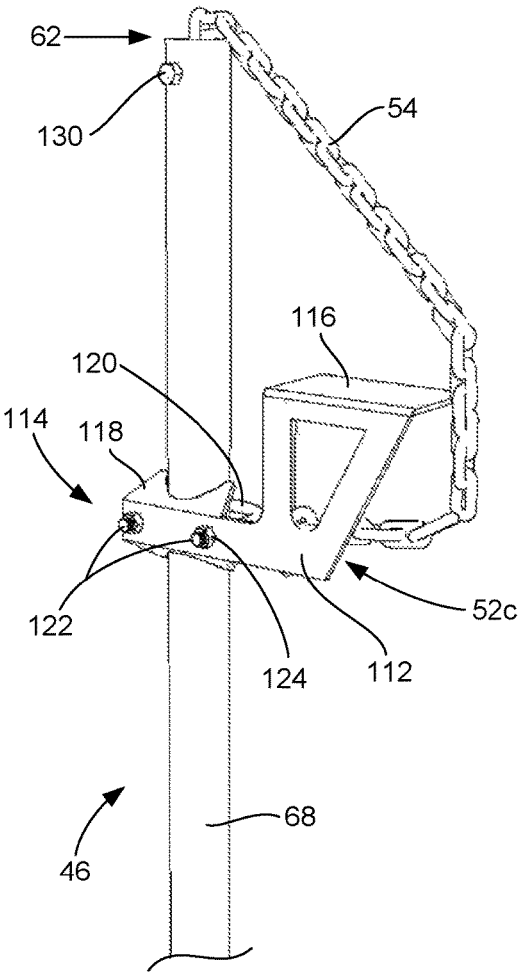
FIG. 6 is an isolated side perspective view of the upper section of the girt alignment apparatus of FIG. 3 to better illustrate the upper end of the support pipe, third girt support assembly and safety chain thereof.
Figure 7:
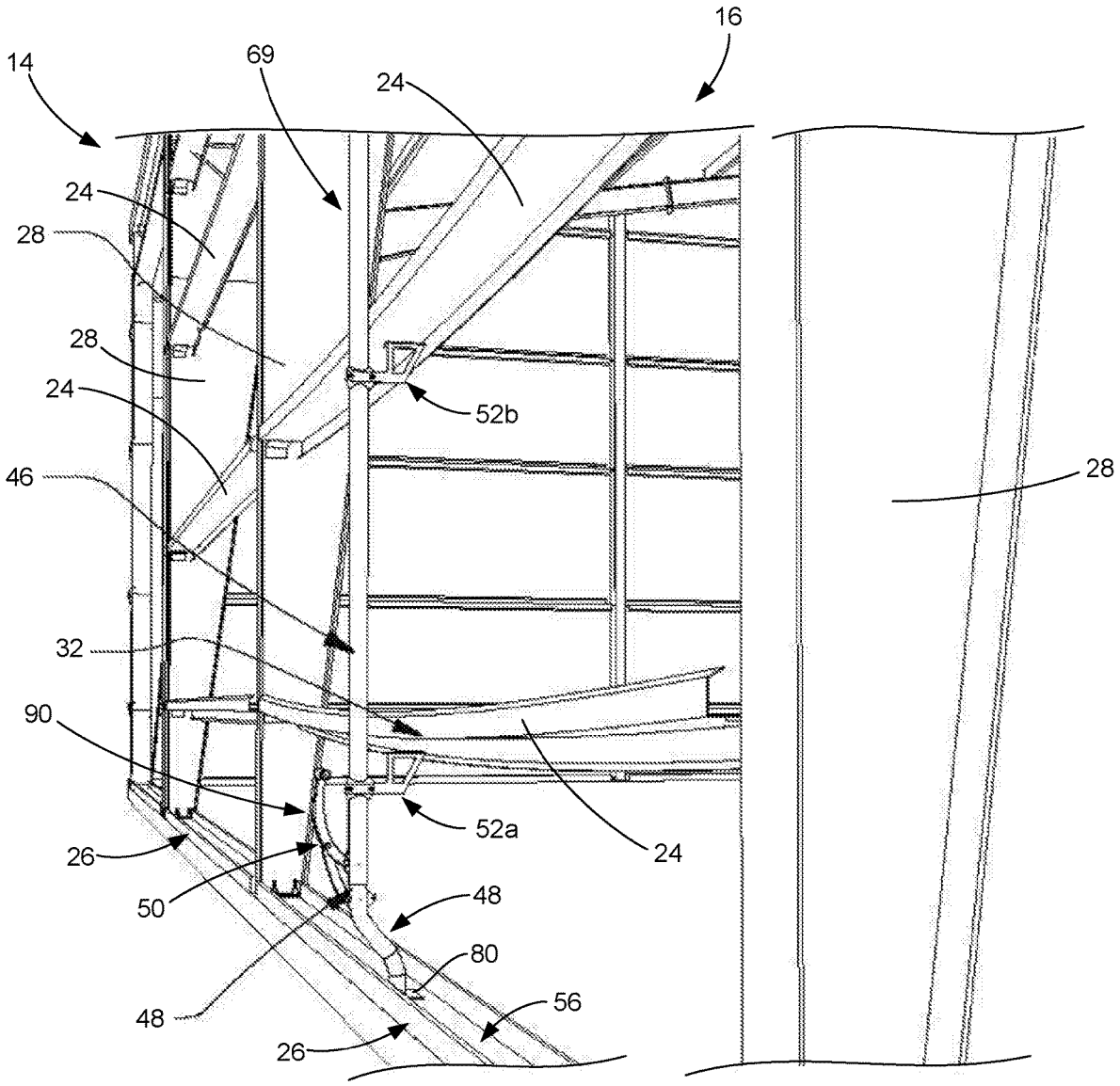
FIG. 7 is a partial side perspective view of the girt alignment apparatus of FIG. 3 shown in use prior to engaging the wind girts of the frame of a building with the wind girts shown in a sagging condition and the lever assembly of the girt alignment apparatus in its retracted position.
Figure 8:
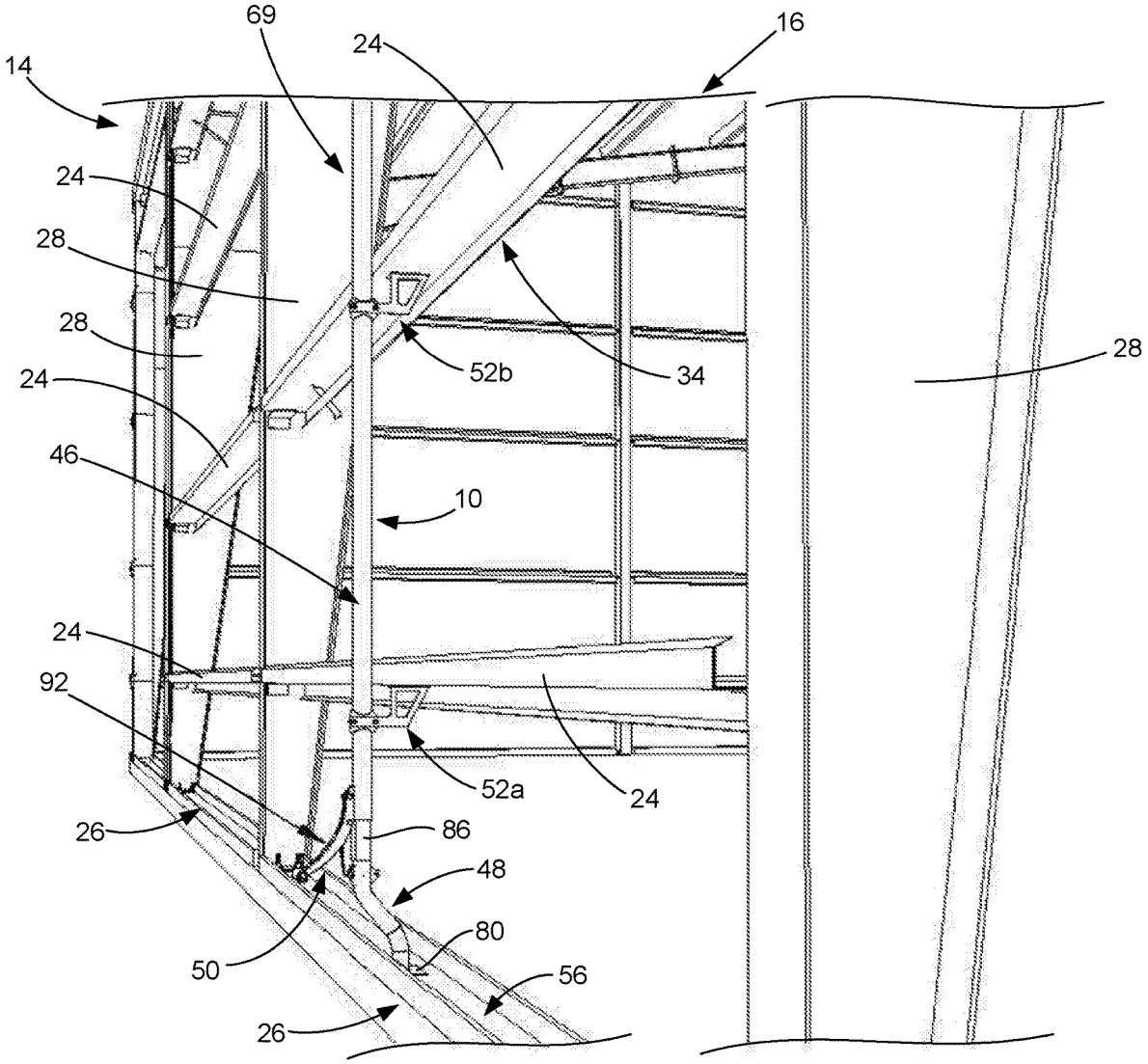
FIG. 8 is a partial side perspective view of the girt alignment apparatus of FIG. 7 with the lever assembly of the girt alignment apparatus shown in its extended position with the girt support assemblies engaging and pressing against the wind girts of the frame of a building placing in the wind girts in a level condition.

A girt alignment apparatus that is configured pursuant to one or more embodiments of the present invention is shown generally as 10 in FIGS. 3, 5-10. A method of using the new apparatus 10 that is configured pursuant to a preferred embodiment of the present invention is shown generally as 12 in FIG. 11. As set forth in more detail below, and best shown with regard to FIGS. 7 and 8, the new apparatus 10 and method 12 are structured and arranged to be utilized to quickly, efficiently and safely level and support components of the frame 14 of a building 16 so the workers can install a panel 18 or a panelized section 20, having a plurality of panels 18, onto the frame 14 of the building 16 to form the walls 22 thereof, such as shown with regard to the prior art frames 14 and buildings 16 of FIGS. 1 and 2. More specifically, the apparatus 10 and method 12 are structured and arranged to allow the users thereof to quickly, accurately and effectively level the horizontally disposed wind girts 24 of the frame 14, which are positioned in the span 26 so as to extend between pairs of adjacent posts 28, as shown in FIGS. 1-2 and 7-9. As set forth in the Background, prior to the present invention, users typically aligned wind girts 24 in a span 26 by placing pieces of dunnage 30, which are commonly made out of wood, between pairs of adjacent wind girts 24, as shown in FIG. 2. The dunnage 30 is sized to move the wind girts 24 from an unsupported sagging condition 32, shown in FIG. 7, to a supported or level condition 34, as shown in FIGS. 2 and 8, and to hold the wind girts 24 in the level condition 34 while the user attaches a panel 18 or a panelized section 20 to the level and aligned wind girts 24 of the frame 14 of the building 16.

Figure 1:
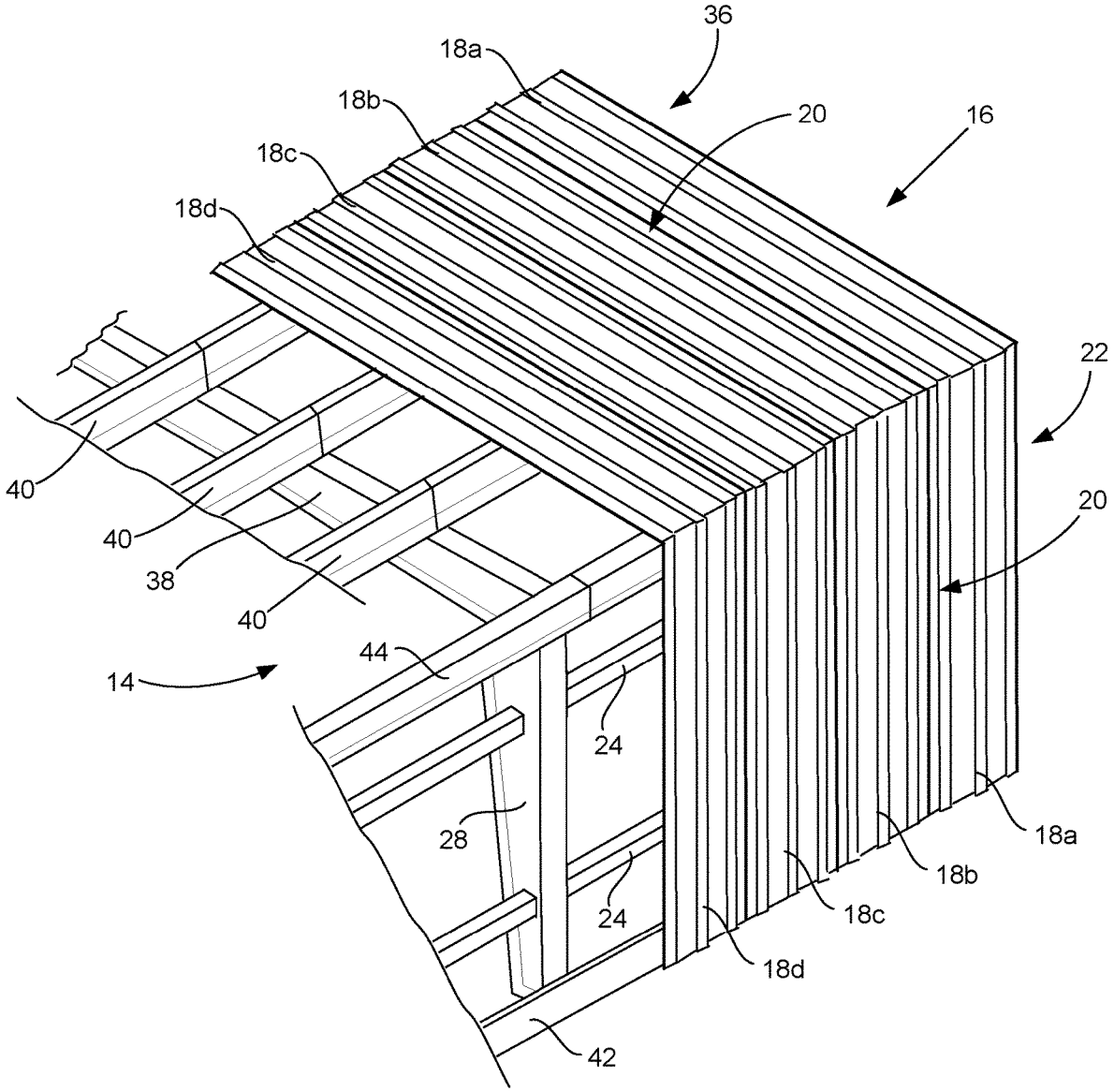
FIG. 1 (PRIOR ART)
FIG. 1 is a prior art side perspective view of a building showing the frame thereof having panelized sections of panels installed on the frame to partially form the wall and roof of the building, with the walls of the frame having a plurality of girts connected to a post and the roof having a plurality of purlins supported by a beam.
Figure 2:
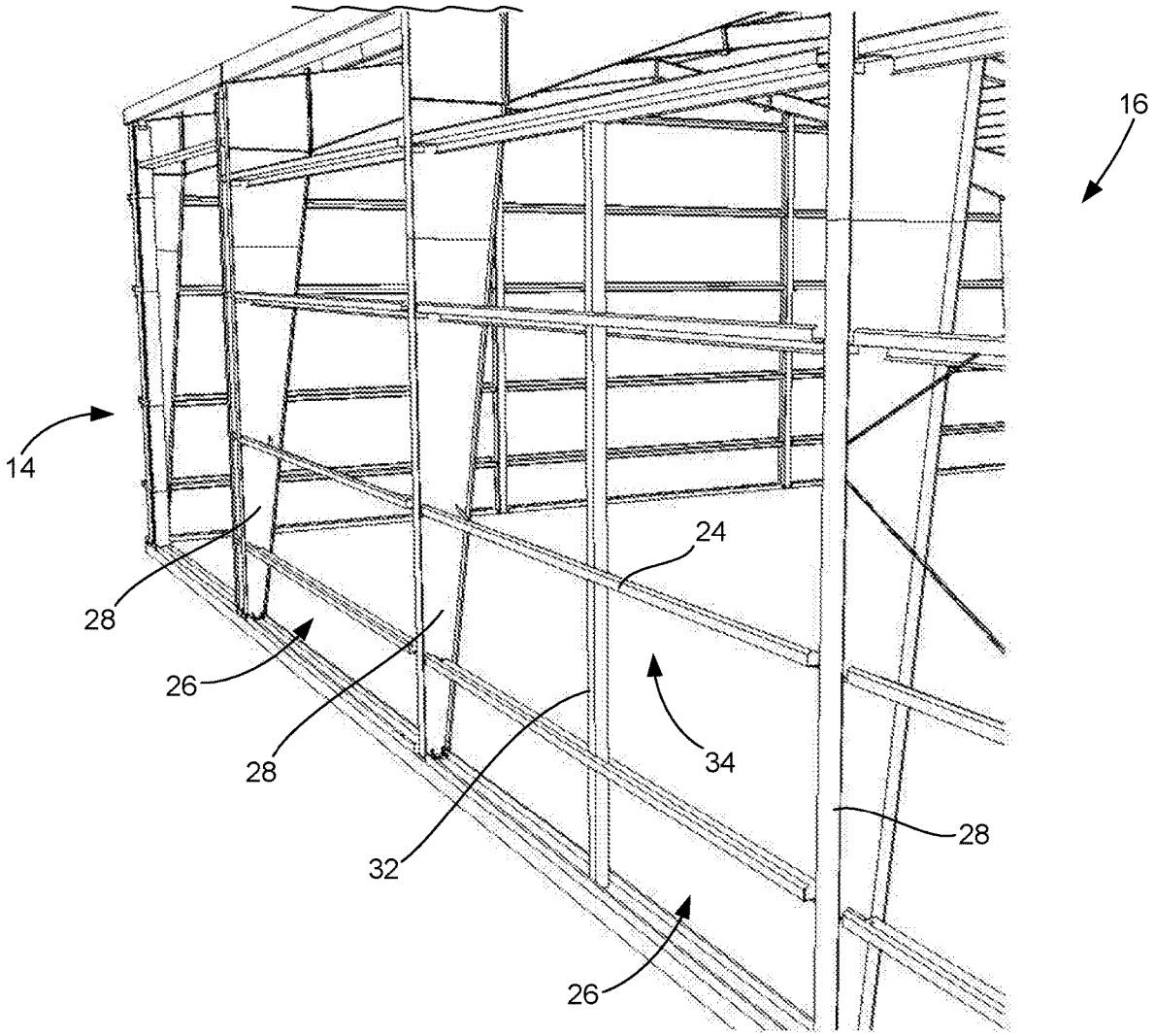
FIG. 2 (PRIOR ART)
FIG. 2 is a prior art side perspective view of a building shown during construction having dunnage positioned between the wind girts to support the wind girts so a panel, panelized section or other wall-forming material may be attached to the wind girts.

In the prior art building 16 of FIG. 1, the walls 22 and roof 36 of the building 16 are made up of a panelized section 20 made up of a plurality of panels, namely panels 18*a*, 18*b*, 18*c* and 18*d*. In one embodiment, the panels 18 of the panelized section 20 were joined together on the ground, floor or other convenient surface and then raised into position as a single panelized section 20 utilizing the apparatuses, systems and methods as set forth in U.S. patent application Ser. No. 16/057,760 (to the same inventor), as described in the Background. A typical building 16 has a frame 14 that comprises a plurality of posts 28, to which one or more horizontally disposed wind girts 24 (such as wind girts 24*a* and 24*b*) are attached and extend between, and a plurality of beams 38 that support purlins 40, such as purlins 40*a*, 40*b* and 40*c*, as shown in FIGS. 1-2. For a metal building, a plurality of panels 18 or panelized sections 20 are attached to the wind girts 24 to form the walls 22 and a plurality of panels 18 or panelized sections 20 are attached to the purlins 40 to form the roof 36, as shown in FIG. 2.

A typical metal building 16, which utilizes metal panels 18 and/or metal panelized sections 20, that can benefit from the new apparatus 10 and method 12 of the present invention has a base member 42 that rests on the foundation (not shown) and an eave strut 44 that defines the upper edge of the walls 22 of the building 16. The vertically disposed posts 28 connect to and extend upward from the base 42 to the eave strut 44. The beams 38 extend inward and slightly upward, for roofs 36 having a pitch (i.e., non-planar roofs 36), from the vertical posts 28. The above description of the components and configuration of a building 16 that utilizes panels 18 or a panelized section 20 of panels 18, particularly metal panels, is only an example of the components and configuration of a building 16 that is being utilized to describe the features and benefits of the present invention. As will be readily appreciated by persons skilled in the art, the apparatus 10 and method 12 of the present invention can be beneficially utilized for any type of similarly configured building 16.

As set forth in the Background, the prior art use of dunnage 32 has a number of disadvantages and problems, including the amount of time and effort to position and remove the dunnage 32 and the possibility of the dunnage 32 falling from the frame 14 onto persons below, which can cause injury or even death. The apparatus 10 of the present invention overcomes these disadvantages and solves the problems with the prior art use of dunnage 30. By eliminating the prior art use of dunnage 30, the apparatus 10 and method 12 of the present invention allows the users thereof to more quickly, efficiently and safely position and support the wind girts 24 while the panels 18, panelized section 20 or other wall components are attached to the wind girts 24 and, as may be necessary, other components of the frame 14. More specifically, the new apparatus 10 and method 12 of the present invention allows the user to position and maintain the position of the wind girts 24 in the level condition 34 without the time and effort of placing and removing a plurality of individual dunnage 30 and without the risk of the dunnage 30 being dislodged and falling on someone.

Figure 5:
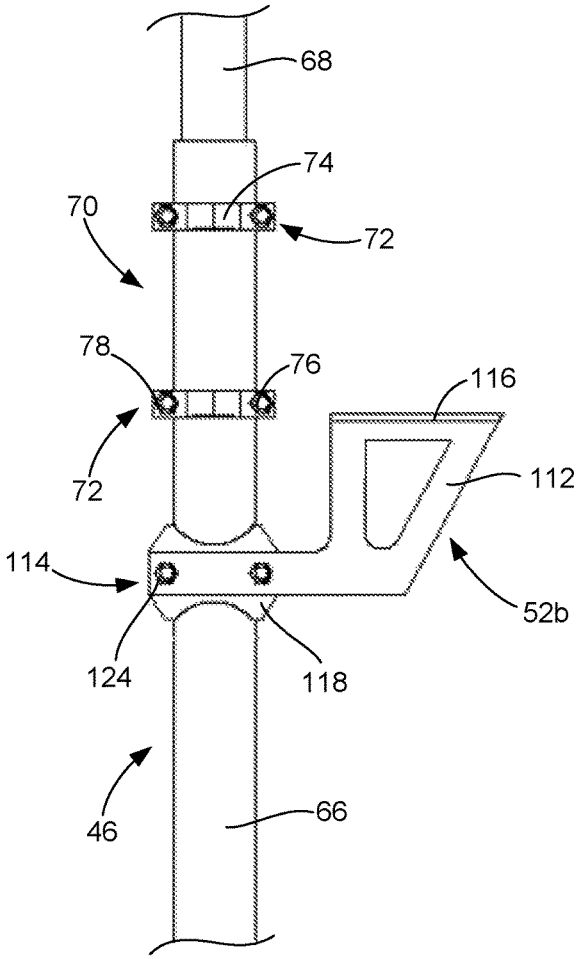
FIG. 5 is an isolated side perspective view of the center section of the girt alignment apparatus of FIG. 3 to better illustrate the telescoping nature of the support pipe, the clamps utilized to fix the height of the apparatus and the second girt support assembly.
Figure 9:
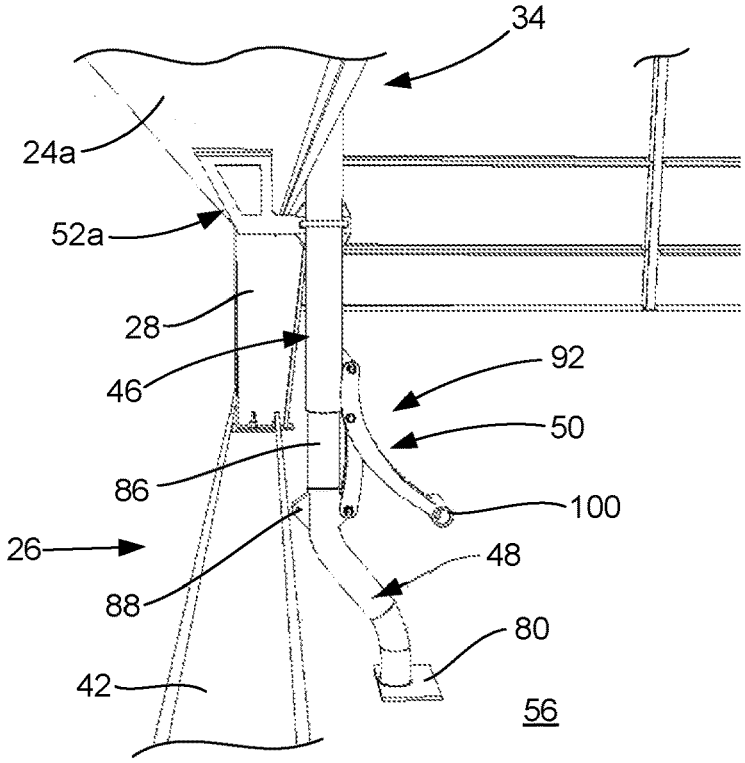
FIG. 9 is a partial side perspective view of the girt alignment apparatus of FIG. 8 showing the first girt support assembly engaging the underside surface of a wind girt.

As best shown in FIGS. 3-6, the girt alignment apparatus 10 generally comprises an elongated support pipe 46, a base assembly 48 that supports the support pipe 46 in a vertically disposed position, a lever assembly 50 that connects the support pipe 46 to the base assembly 48 to move the support pipe 46 in an up and down direction relative to the base assembly 48, at least one girt support assembly 52 attached to the support pipe 46 at a position to engage and support a wind girt 24 to hold the wind girt 24 in the level condition 34 and a safety chain 54 that is utilized to prevent the apparatus 10 from inadvertently falling and to assist, as may be desired, the user with moving the apparatus 10. The various features of the apparatus 10 are set forth in more detail below. In summary, the apparatus 10 is placed in position in the span 26 between posts 28 where the wind girts 24 are in their sagging condition 32 with the base assembly 48 placed on the ground, floor, foundation or other support surface 56 in the span 24 and a girt support assembly 52 below the wind girt 24 to be leveled, as shown in FIGS. 7-9 and in the chart of the method 12 in FIG. 11. The user operates the lever assembly 50 to raise the support pipe 46, which raises the girt support assembly 52, to engagedly contact the wind girt 24 to place the wind girt 24 in its leveled condition 34, as shown in FIG. 8. With the lever assembly 50 locked in position holding the wind girts 24 level, the user can quickly, efficiently and safely attach metal panels 18, panelized sections 20 and/or other wall members to the wind girts 24 of the frame 14 to form the walls 22 of the building 16. Once the panels 18, panelized section 20 and/or other wall members are attached to the wind girts 24 and/or other components of the frame 14, the user operates the lever assembly 50 to lower the support pipe 46 to disengage the girt support assembly 52 from the wind girt 24. The apparatus 10 is then moved to another span 26 so the user can support and level the wind girts 24 in that span 26. In certain uses of the new apparatus 10, the safety chain 54 is utilized to prevent the apparatus 10 from falling if it inadvertently becomes dislodged from the frame 14 and to move the apparatus 10 to the next span 26 by securing safety chain 54 to a crane or other aerial lifting machine.

Figure 3:
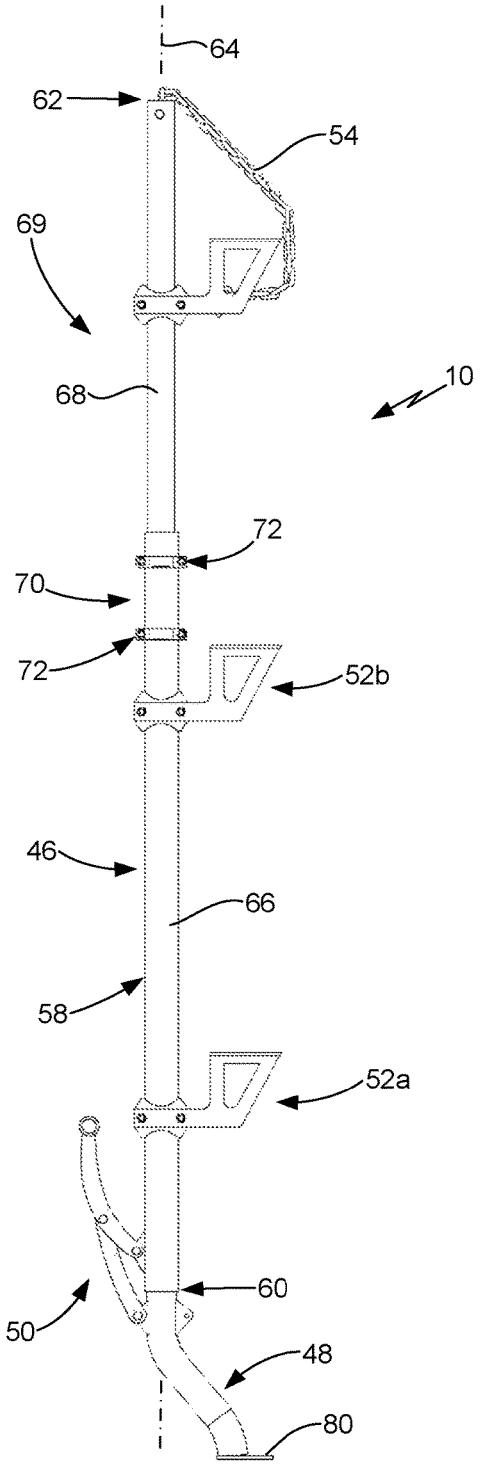
FIG. 3 is a side view of a girt alignment apparatus configured according to a preferred embodiment of the present invention with the lever assembly thereof shown in its retracted position.

The elongated support pipe 46 has a pipe body 58 that defines a first or lower end 60 and a second or upper end 62 of the support pipe 46 and an elongated pipe axis 64 through the support pipe 46 (i.e., between the first/lower end 60 to the second/upper end 62), as best shown in FIG. 3. In a preferred embodiment, the pipe body 58 is tubular and has a circular or round cross-section. In various other embodiments, the pipe body 58 can be solid or filled with material and has shapes other than a circular/round cross-section, such as an oval, square, rectangular or other shaped cross-section. The pipe body 58 can be a single, elongated member that is of sufficient length to have the number of girt support assemblies 52 that are needed so that each of the horizontally disposed wind girts 24 will be engaged and supported by one girt support assembly 52 (i.e., one girt support assembly 52 for each wind girt 24). In a preferred embodiment of the present invention, such as the apparatus 10 shown in FIG. 3, the support pipe 46 can be made out of two or more elongated pipe members, such as a first or lower pipe member 66 and a second or upper pipe member 68, that are configured in engaging or telescoping arrangement to allow the user to move the second/upper pipe member 68 upward and downward to obtain the desired length, which will be the height when the apparatus 10 is in its normal use upright position 69 (i.e., as shown in FIGS. 3 and 7-8) that is necessary to for each wind girt 24 in a span 26 of the frame 14 to be engaged and supported by one girt support assembly 52. In the embodiment shown in the figures, the first/lower pipe member 66 has a cross-section which is larger than the cross-section of the second/upper pipe member 68, as best shown in FIGS. 3 and 5, such that the second/upper pipe member 68 will upward and downward in the first/lower pipe member 68.

To allow the user to secure the support pipe 46 at its desired height, the apparatus 10 has a pipe length securing mechanism 70 that is cooperatively configured with the pipe members 66/68 and is structured and arranged to secure the relative position of the pipe members 66/68 to each other so as to fix the length of the support pipe 46 (i.e., height of the apparatus 10). In the embodiment shown in the figures, securing mechanism 70 has one or more clamping devices 72 (two are shown) that each comprise a clamping member 74 that is tightly engaged by a U-shaped bolt 76 and cooperatively configured connecting members 78 (such as a nut or the like) in a manner such that when the clamping member 74 is clamped against the pipe body 58 by the U-shape bolt 76 and connecting members 78, the two pipe members 66/68 will be engaged with each other to prevent upward and downward movement of the pipe members 66/68 relative to each other. As will be readily understood by persons who are skilled in the art, a wide variety of different types of and configurations of securing mechanism 70 can be utilized with the new apparatus 10. For instance, the securing mechanism 70 of apparatus 10 can be of the type that is not a clamping device 72 or is a clamping device 72 that does not utilize a clamping member 72, U-shaped bolt 74 and connecting members 76. The securing mechanism 70 can be of the type that comprises a removable pin and a plurality of apertures, a retractable pin that extends through an aperture, threads which allow one pipe member 66/68 to move relative to the other pipe member 66/68, friction engagement between the two pipe members 66/68, a set screw or other connector through the outer pipe member 66/68 to engage the outer surface of the inner pipe member 66/68, a variety of internally disposed devices that can be utilized as the length adjusting mechanism 70, or the like.

For purposes of describing the present invention, for purposes of describing the use and relative location of the various components of the present invention, the terms "upper", "upward", "upwardly", "upper" and "top" and the like and the terms "lower", "downward", "downwardly" and "bottom" and the like refer to the direction, respectively, of the first/lower end 60 and second/upper end 62 of the support pipe 46 when the apparatus 10 is in its normal upright position 69 when in use to engage one or more horizontally disposed wind girts 24 of the frame 14 of building 16, as shown in FIGS. 3 and 7-8. Likewise, the terms "front", "forward", "forwardly" and the like and the terms "back", "rearward", "rearwardly" and the like are utilized to refer to the direction components of the base assembly 48, lever assembly 50 and girt support assemblies 52 are outwardly directed (relative to the elongated pipe axis 64 through the center of the elongated support pipe 46, as best shown in FIG. 3). As will be readily appreciated by persons skilled in the art, at a minimum, the present invention requires each of the girt support assemblies 52 to extend outwardly from the support pipe 46 so they can contact and engage a wind girt 24 to move one or more wind girts 24 from its sagging condition 32 to its level condition 34 and to hold the one or more wind girts 24 in a level condition 34 while the components of the wall 22 are attached to the wind girts 24.

The base assembly 48 is structured and arranged to support the new apparatus 10 on a support surface 56 when the apparatus 10 is in use to level and support at least one wind girt 24. In the preferred embodiment, the base assembly 48 is utilized with the lever assembly 50 and support pipe 46 to provide a fixed component against which the lever assembly 50 operates to move the support pipe 46 upward or downward, relative to the base assembly 48 and support surface 56, to allow the girt support assemblies 52 to engage and support the wind girts 24, as shown in FIG. 8. Alternatively, the lever assembly 50 can be configured to engage the support surface 56 or other surface, as opposed to the base assembly 48, to provide the necessary leverage to raise the support pipe 46. In one configuration of the preferred embodiment, the base assembly 48 comprises just a footplate 80 that is sized and configured to engage the support surface 56 in a manner which allows the user to easily and safely utilize the apparatus 10 to level and support one or more wind girts 24 during construction of building 16. In the embodiment where lever assembly 50 does not connect to the base assembly 48, footplate 80 can be integral with the first/lower end 60 of support pipe 46 and be dimensioned the same as the support pipe 46 (i.e., be the bottom surface of the support pipe 46). Typically, however, the footplate 80 will be sufficiently dimensioned (i.e., the length and width or the diameter) to safely engage the support surface 56 and at least the bottom surface of the footplate 80 will be planar to lay flat against a planar support surface 56, as is generally common for most floors, foundations and other components at or near the portion of the frame 14 where the wind girts 24, spans 26 and posts 28 are located.

Figure 4:
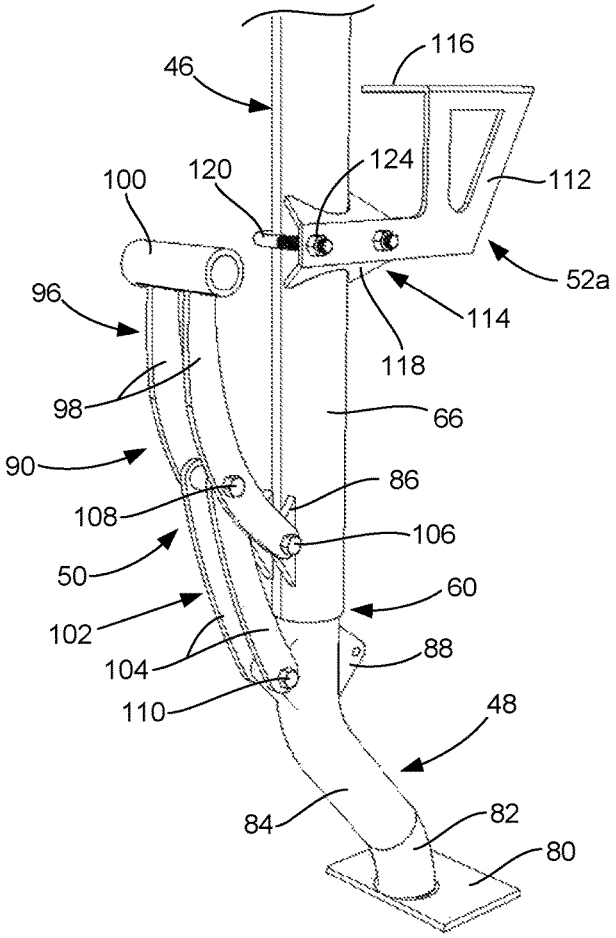
FIG. 4 is an isolated side perspective view of the lower section of the girt alignment apparatus of FIG. 3 to better illustrate the lower end of the support pipe, base assembly, lever assembly and the first girt support assembly thereof.

In the embodiment of the apparatus 10 shown in the figures, the base assembly 48 also comprises one or more curved shaft members, shown as first curved shaft member 82 and second curved shaft member 84 in FIG. 4, an inner shaft member 86 and one or more lever mounts 88, as best shown in FIGS. 3-4 and 8. The curved shaft members 82/84 extend upward from the footplate 80 to the first/lower end 60 of the support pipe 46 when the lever assembly 50 is in its retracted position 90, as shown in FIGS. 3, 4 and 7. Although the shaft members 82/84 can be straight, the use of at least one shaft member 82/84 being curved provides an offset base assembly 48 that will allow the user to rotate the base assembly 48 so the components thereof will clear the base of the wall panel and the wall panel's attachment point. In addition, the curved shaft members 82/84 provide a reversible base assembly 48 that will clear any curbing, wainscot or the like when the apparatus 10 is utilized at the interior of the building 16. The inner shaft member 86 of the base assembly 48 is sized and configured to fit inside the lower end 60 of the support pipe 64 in a manner which allows the first/lower pipe member 66 to move upward relative to the base assembly 48 to place the lever assembly 50 in its extended position 92, as shown in FIG. 8, to engage, lift, level and support wind girts 24 to move the wind girts 24 from their sagging condition 32 to their level condition 34 and then back down to its retracted position 90 after the components of wall 22 are installed on the wind girts 24 and/or other components of the frame 14. As set forth in more detail below, in the preferred embodiments of the new apparatus 10, a lower section of the lever assembly 50 is attached to a lever mount 88 to provide the resistance to the force which is utilized by the lever assembly 50 to raise and lower the support pole 46 as the lever assembly 50 is moved between its retracted position 90 and extended position 92. Preferably, the base assembly 48 has lever mounts 88 at least on the opposite facing sides of one of the shaft members 82/84, as best shown in FIGS. 3-4 and 7-9, so the lever assembly 50 can attached to the base assembly 48 when the base assembly 48 is rotated to be placed in an offset position or otherwise positioned to clear any building components.

As set forth above, the lever assembly 50 is structured and arranged to allow the user to raise the support pipe 46, and therefore the one or more girt support assemblies 52 attached thereto, when he or she desires to engage one or more wind girts 24 and move the wind girts 24 from their sagging condition 32 to the level condition 34, as shown with regard to FIGS. 7 and 8, and then disengage from the wind girts 24 after the panels 18, panelized section 20 and/or other wall components are installed. In one configuration, the lever assembly 50 is structured and arranged to engage the support surface 56 by interconnecting the support pipe 46 and the support surface 56. In the preferred embodiments, however, the lever assembly 50 is positioned to span the area of the first/lower end 60 of the support pipe 46 and the base assembly 48 and is configured to operate as a jack lever to raise and lower the support pipe 46 and the girt support assemblies 52 attached thereto. More specifically, in the embodiment of the present invention shown in the figures, the lever assembly 50 attaches to a lever mount 94 attached to or integral with the first/lower pipe member 66 of the support pipe 46 just above the first/lower end 60 thereof and to the lever mounts 88 on the second curved shaft member 82 of the base assembly 48 below the first/lower end 60 of the support pipe 46, as shown in FIGS. 3-4 and 7-9. In other embodiments, the lever assembly 50 can attach to one or more other components of the support pipe 46 and the base assembly 48, such as to the first curved shaft member 82 or footplate 80.

The lever assembly 50 shown in the figures has an upper section 96 comprising one or more upper lever members 98, such as the two shown FIG. 4, a lever handle 100 attached to or integral with the upper lever members 98, and a lower section 102 comprising one or more lower lever members 104, such as the two shown in FIG. 4. The upper section 96 of lever assembly 50 is cooperatively structured and arranged with the upper lever mount 94 that is associated with the support pipe 46 so as to be pivotally attach thereto. The lower section 102 of lever assembly 50 is cooperatively structured and arranged with the lower lever mount 88 that is associated with the base assembly 48 so as to be pivotally attached thereto. In addition, the upper section 96 and the lower section 102 are pivotally attached to each other to allow the two sections 96/102 to pivot relative to each other. In the embodiments shown in the figures, the upper section 96 has a pair of upper lever members 98 that pivotally attach to the upper lever mount 94 with a first elongated pivot member 106, the lower section 102 has a pair of lower lever members 104 that pivotally attach to the lower lever mount 94 with a second elongated pivot member 108 and the pair of lower lever members 104 pivotally attach to the pair of upper lever members 98 with a third elongated pivot member 110, as best shown in FIG. 4. In a preferred embodiment, each of the pivot members 106/108/110 are the same and comprise a bolt (such as a pivot bolt, shoulder bolt or the like) and appropriate nuts that allows the various pivot members 106/108/110 to pivotally connect. As well known to persons skilled in the art, a wide variety of other devices (including flange bearings, pins and the like) can be utilized as the pivot members 106/108/110.

With the appropriate number and placement of girt support assemblies 52 on the support pipe 46, as set forth below, the user places the apparatus 10 in position below the wind girts 24, which will be in their sagging condition 32, of the frame 14 of a building 16, such as shown in FIG. 7, with the lever assembly 50 of the apparatus 10 in its retracted position 90, as shown in FIGS. 3-4, 7 and 9. As will be readily appreciated by persons who are skilled in the art, when the user presses downward on the handle 100 of the lever assembly 50, the pivoting action of the upper section 96 and lower section 102 will cause the lever assembly 50 to move to its extended position 92 and push the support pipe 46 upward and raise the girt support assemblies 52 into engagement with the wind girts 24 to move the wind girts 24 to their level condition 34. The user can utilize his or her hand or foot to operate the lever assembly 50. The lever assembly 50 is configured such that when the handle 100 is lowered, with the lever assembly 50 in its extended position 92, the support pipe 46 and girt support assemblies 52 will be remain upwardly disposed to hold the wind girts 24 in their level condition 34 so the user can easily, efficiently and safely attach the components of the wall 22 to the frame 14. Once the wall components are attached, the user lifts up on the handle 100 to move the lever assembly 50 back to its retracted position 90, which will lower the support pipe 46 and girt support assemblies 52, to allow the user to remove the apparatus 10 from the span 26 and, as may be necessary, move the apparatus 10 to a position in a different span 26 to raise, level and support the wind girts 24 in the second span 26 to install wall components thereto.

In a preferred configuration of the new apparatus 10, each girt support assembly 52 is structured and arranged to securely, but moveably, attach to the pipe body 58 of the support pipe 46 and to engage a wind girt 24 so as to move upward with the support pipe 46 as it moves upward by the user moving the lever assembly 50 to its extended position 92 and move the wind girt 24 from its sagging condition 32 to its level condition 34, as shown in FIGS. 3-10. Specifically, the girt support assemblies 52 are attached to or integral with the support pipe 46 so as to extend outwardly therefrom (i.e., relative to the pipe axis 64, as shown in FIG. 3) and engage the wind girts 24 of the frame 14. In one embodiment, one or more of the girt support assemblies 52 are fixedly attached to or integral with one or more of the pipe members 66/68 of the support pipe 46 so as to move upward and downward with the support pipe 46 as the lever assembly 50 moves between the retracted position 90 and extended position 92 and back to the retracted position 90, as shown with regard to FIGS. 7-8. As will be readily appreciated by persons who are skilled in the art, a fixed/integral configuration requires the wind girts 24 to always be at the same position relative to each other and to the support surface 56. In a preferred embodiment, each of the girt support assemblies 52 are moveably attached to the support pipe 46 so the user can utilize the apparatus 10 for different placements of the wind girts 24 in the frame 14 of different buildings. In yet another embodiment, one or more of the girt support assemblies 52 can be fixedly attached to or integral with the support pipe 46 and one or more other girt support assemblies 52 can be moveably attached to the support pipe 46. Any moveable girt support assemblies 52 must be configured in a manner which allows the user to secure the girt support assemblies 52 to the support pipe 46 so that the girt support assemblies 52 are fixed in position on the support pipe 46 when the lever assembly 50 of the apparatus 10 is operated to move its associated wind girt 24 from its sagging condition 32 to its level condition 34, as shown in FIGS. 7-8.

In the embodiment shown in the figures, each girt support assembly 52 is moveably attached to the support pipe 46 and configured to allow the user to tightly secure the girt support assembly 52 in the desired girt supporting position, which is the position where the girt support assembly 52 needs to be located so it will engagedly abut against and support the wind girt 24 when the lever assembly 50 is in its extended position. The girt support assemblies 52 shown in the figures comprise a bracket 112 that is sized and configured to extend outwardly from the support pipe 46, a pipe attachment mechanism 114 which is attached to or integral with the bracket 112 to securely, but moveably, attach the bracket 112 to support pipe 46 and a girt contact plate 116 that is attached to or integral with the bracket 112 and sized and configured to engagedly contact and support a wind girt 24, as best shown in FIGS. 6 and 8-10. In a preferred configuration, the girt contact plate 116 has a planar upper surface and the bracket 112 and girt contact plate 116 are cooperatively arranged such that the girt contact plate 116 is held in a horizontal position, as best shown in FIGS. 3-6, so the planar upper surface thereof will press against the bottom surface of the wind girt 24 when the lever assembly 50 is moved to its extended position 92 to move the wind girt 24 to its level condition 34, as shown in FIGS. 8-9. If desired, however, the upper surface of the girt contact plate 116 can be non-planar, such as the upper end of the bracket 112, a separate vertical member or the like. Preferably, each of the girt support assemblies 52 are sized and configured to provide clearance for use with different sized flanges, webs and profiles of the horizontal framing members (such as wind girts 24).

Figure 10:
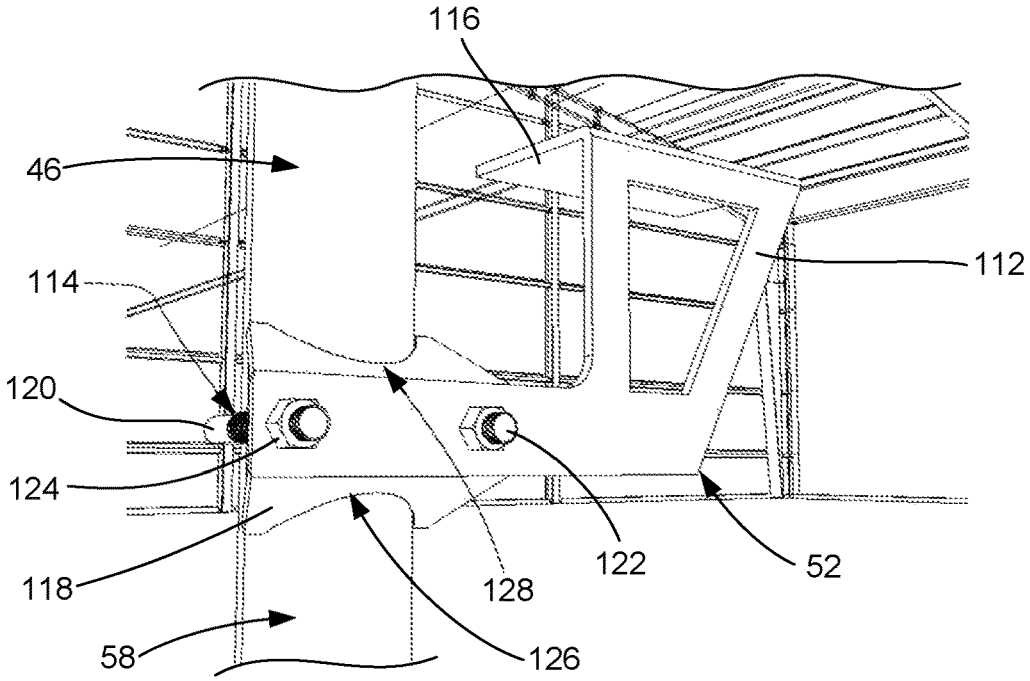
FIG. 10 is a side perspective view of the second girt support assembly shown secured to the support pipe.
Figure 11:
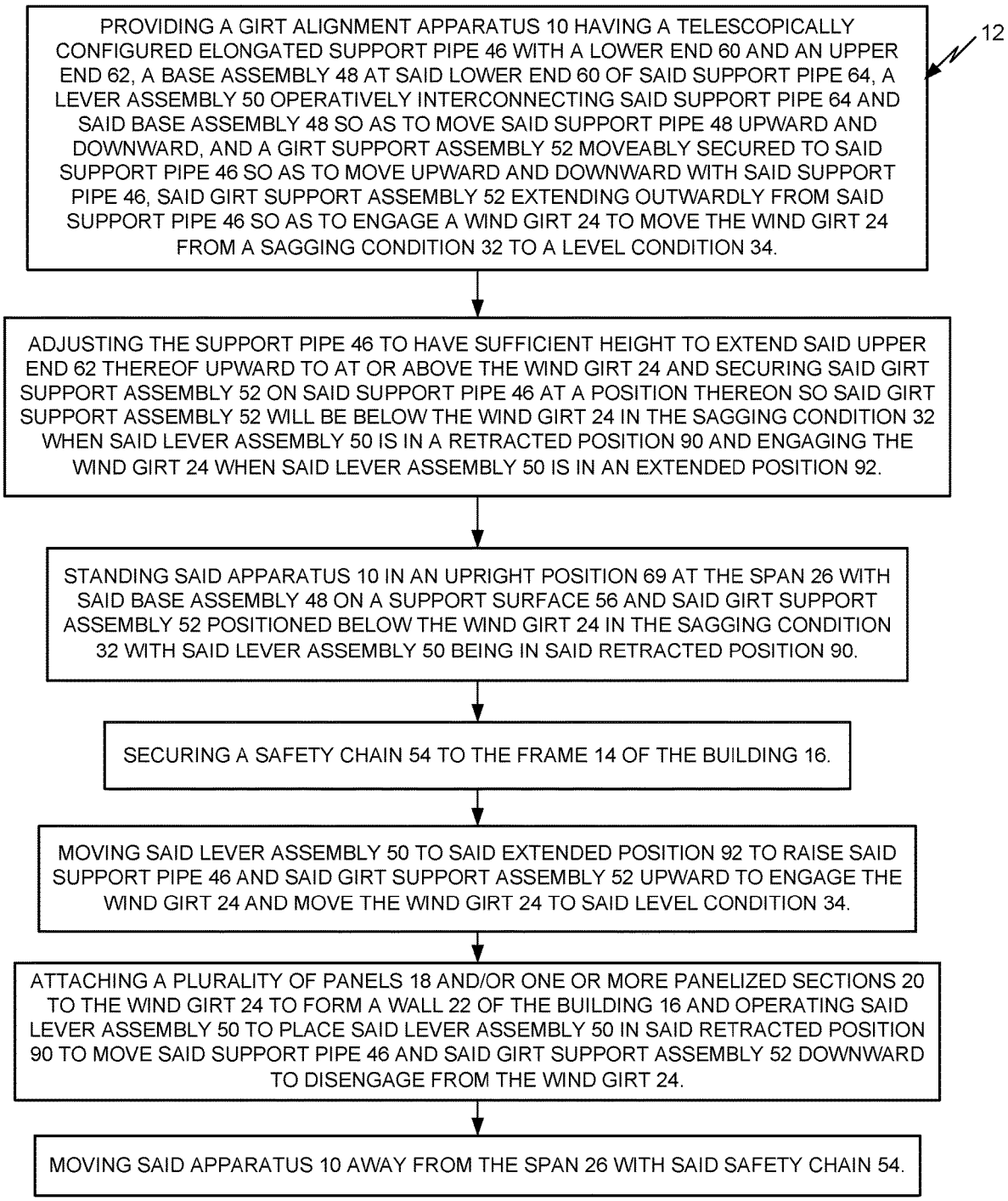
FIG. 11 is a flow chart setting forth one of the preferred embodiments of the method of using the girt alignment apparatus of the present invention.

In the embodiment shown in the figures, pipe attachment mechanism 114 is structured and arranged to moveably engage, but subject to being tightly engaged with, the support pipe 46. In one configuration, the pipe attachment mechanism 114 has an engaging bracket 118 and a cooperatively configured engaging member 120. The engaging bracket 118 is sized and configured to be placed in close abutting relation with the pipe body 58 of the support pipe 46 and the engaging member 120 is sized and configured to extend around the support pipe 46 and be engaged with the engaging bracket 118 to pull the engaging bracket 118 tightly against the pipe body 58 to secure a girt support assembly 52 in place on the support pipe 46, as best shown in FIGS. 4-6. In the embodiment shown in the figures, the engaging member 120 is a U-shaped bolt that has a pair of threaded ends 122 that are threadably engaged by appropriately configured connecting members 124, such as the nuts shown in the figures, to press the engaging bracket 118 against support pipe 46. In the embodiment where the pipe body 58 of the support pipe 46 has a round cross-sectional shape, such as a cylindrical tubular shape, the engaging bracket 118 can be configured with a first or lower contact edge 126 and a second or upper contact edge 128 that are configured with a curved shape (i.e., a semi-circular shape) to help the engaging bracket 118 to more securely engage and press against the pipe body 58 of the support pipe 46, as best shown in FIG. 10.

As will be readily appreciated by persons who are skilled in the art, a wide variety of other components and different configurations of such components can be used for the girt support assemblies 52 other than those described above. For instance, the pipe attachment mechanism 114 can be modified as may be necessary or beneficial to connect to support pipes 46 other than a cylindrical pipe body 58, such as a support pipe 46 having a pipe body 58 that has a square, rectangle or oval cross-section. In addition, the pipe attachment mechanism 114 can be configured to engage the support pipe 46 in significantly different manners other than having an engaging bracket 118 pressed against the pipe body 58 thereof. For instance, pipe body 58 can have a plurality of apertures therein or therethrough that a bolt, screw or other connector is passed into or through to secure the bracket 112 to the support pipe 46. Likewise, the pipe attachment mechanism 114 can comprise a pair of engaging brackets 118 that are attached to each other to hold the bracket 112 in place on support pipe 46. As set forth above, in embodiments where changing the location of the girt support assemblies 52 will not be necessary (such as always having the same spacing between the wind girts 24), the bracket 112 can be fixedly attached to or integral with the pipe body 58 of the support pipe 46.

The support chain 54 is utilized to secure the apparatus 10 to one or more frame members of the frame 14 to prevent the apparatus 10 from becoming dislodged and falling free, which could injure persons below, and to connect to a crane or other aerial lifting machine for moving the apparatus 10. As best shown in FIG. 6, one end of the support chain 54 is attached to the support pipe 46, typically at or near the second/upper end 62 thereof, by a chain attachment device 130, which can be a bolt, screw or the like. The other end of the safety chain 54, which is referred to the free end of the safety chain 54, is loose so it can be secured to the frame 14 of the building or to a cable of a crane or other aerial lifting machine. In a preferred embodiment, the free end of the safety chain 54 has a clip, hook or other securing device (not shown) attached thereto. As well known in the art, such securing devices allow the user to more easily and safely loop the chain around a frame member of the frame 14 and connect to itself and to more easily and safely connect the support chain 54 to a crane or other aerial lifting machine.

As set forth in the Background, when the wind girt 24 is in a sagging condition 32, which is due to the natural sag of supporting its own weight, the user will have difficulty attaching the components of the wall 22, such as panels 18, panelized section 20 and the like, to the frame 14 of building 16 in a manner which is effective, efficient and aesthetically pleasing. The apparatus 10 is structured and arranged to raise and level the wind girts 24 without the potential problems of the prior art use of dunnage 30 and the like, such as shown in FIG. 2. Specifically, when the handle 100 of the lever assembly 50 is pressed downward, the girt support assemblies 52 will move upward to shore a wind girt 24 in the correct elevation, while locking apparatus 10 in place, so the user can quickly, efficiently and safely attach the wall components, such as the panels 18, panelized section 20 or the like, to the frame 14 to form the walls 22 of the building 16.

A method 12 of utilizing the new apparatus 10, generally comprises the steps of: (1) utilizing the length adjusting mechanism 70 to extend the support pole 46 to have sufficient height to extend upward above the uppermost wind girt 24 and installing a girt support assembly 52 for each wind girt 24 to the pipe body 58 of the support pipe; (2) positioning each girt support assembly 52 on the support pipe 46 so a girt support assembly 52 will be below each wind girt 24; (3) operating the pipe attachment mechanism 114 of girt support assembly 52 to tightly secure each girt support assembly 52 to the support pipe 46; (4) standing the apparatus 10 in its upright position 69 at a span 26 between the posts 28 of the frame 14 of a building 16 with the footplate 80 thereof on the support surface 56, the girt contact plate 116 of each girt support assembly 52 positioned below a wind girt 24 that is in its sagging condition 32 and the lever assembly 48 in its retracted position 90; and (5) moving the lever assembly 50 to its extended position 92 to raise the support pipe 46 and the girt support assemblies 52 upward to engage each wind girt and move each wind girt 24, in one operation, to their level condition 34. If desired, the user can secure the free end of the safety chain 54 to other components of the frame 14 to prevent the apparatus 10 from falling during use thereof. Once each of the wind girts 24 are in their level condition 34, the user can install the panels 18, panelized sections 20 and/or other wall components to the frame 14 to form the walls 22 of the building 16. Once the wall components are installed, the user moves the lever assembly 50 back to its retracted position 90 and moves the apparatus 10 away from the frame 14, such as to a new location in another span 26 of the frame 14. If desired, the user can attach the free end of the safety chain to a crane or other aerial lifting machine to quickly and easily move the apparatus 10 to its next location.

The components of the new apparatus 10, including the support pipe 46, base assembly 48, lever assembly 50 and the girt support assemblies 52 can be made out of wide variety of materials that are sufficiently strong and rigid to support the support pipe 46 in a stiff upright position with the footplate 80 pressed against the support surface 56 and the girt support assemblies 52 pressed against the wind girts 24 in order to move the wind girts 24 from their sagging condition 32 to their level condition 34. The safety chain 54, which is preferably flexible, should be sufficiently strong to prevent the apparatus 10 from falling and to allow the user to move the apparatus 10 with a crane or other aerial lifting machine. Preferably, the material selected for these components will also be sufficiently corrosion resistant so that it will not corrode when utilized and stored outside. As will be readily appreciated by persons who are skilled in the art, various metals, plastics, composites and the like can be utilized for different or all of the components of the apparatus 10. In one embodiment, the primary material is steel that is selected, treated or coated to reduce the likelihood of corrosion issues.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there may be numerous components of the embodiments described herein that can be readily replaced with equivalent functioning components to accomplish the objectives and obtain the desired aspects of the present invention. The various embodiments set forth herein are intended to explain the best mode of making and using the present invention as currently known to and appreciated by the present inventor and to enable other persons who are skilled in the relevant art to manufacture and utilize the present invention. Although, the described embodiments may comprise different features, not all of these features are required in all embodiments of the present invention. More specifically, as will be readily appreciated by persons who are skilled in the art, certain embodiments of the present invention only utilize some of the features and/or combinations of features disclosed herein.

What is claimed is:

1. An apparatus for leveling and supporting a wind girt in a span between posts of a frame of a building, said apparatus comprising:

a support pipe having an elongated pipe body defining an upper end and a lower end of said support pipe and a pipe axis between said lower end and said upper end thereof;

a base assembly at said lower end of said support pipe, said base assembly structured and arranged to support said support pipe in an upright position on a support surface at or adjacent the span between the posts, said base assembly having a footplate, one or more curved shaft members and an inner shaft member, said one or more curved shaft members disposed between said footplate and said lower end of said support pipe, said inner shaft member positioned above said one or more curved shaft members and disposed inside said lower end of said support pipe to allow said support pipe to move upward and downward relative to said base assembly;

a lever assembly operatively connected to said support pipe so as to move said support pipe upward when said lever assembly is moved to an extended position and to move said support pipe downward when said lever assembly is moved to a retracted position; and a girt support assembly having a bracket attached to or integrally formed with said support pipe so as to move upward and downward with said support pipe, said bracket extending outward from said support pipe and positioned on said support pipe so as to engage the wind girt when said lever assembly is moved to said extended position to move the wind girt from a sagging condition to a level condition.

2. The apparatus of claim 1, wherein said support pipe comprises two or more pipe members and a length adjusting means cooperatively configured with said two or more pipe members for adjusting the length of said support pipe.

3. The apparatus of claim 2, wherein said two or more pipe members are telescopically configured.

4. The apparatus of claim 3, wherein said length adjusting means comprises one or more clamping devices that are configured to fix the length of said support pipe.

5. The apparatus of claim 1, wherein said lever assembly connects said support pipe and said base assembly so as to move said support pipe upward when said lever assembly is moved to said extended position and downward when said lever assembly is moved to said retracted position.

6. The apparatus of claim 5, wherein said lever assembly connects to one or more lever mounts attached to or integral with said support pipe and to one or more lever mounts attached to or integral with said base assembly.

7. The apparatus of claim 5, wherein said lever assembly comprises one or more upper lever members pivotally connected to said support pipe and one or more lower lever members pivotally connected to said base assembly, said upper lever members and said lower lever members being pivotally connected to each other to allow said lever assembly to move between said retracted position and said extended position.

8. The apparatus of claim 1, wherein said girt support assembly comprises a pipe attachment means for moveably attaching said bracket to said support pipe so as to adjust the position of said bracket on said support pipe.

9. The apparatus of claim 1, wherein said girt support assembly has a girt contact plate, an engaging bracket and an engaging member, said girt contact plate sized and configured engage the wind girt, said engaging bracket and said engaging member cooperatively configured to secure said girt support assembly to said support pipe.

10. The apparatus of claim 1 further comprising a safety chain, said safety chain sized and configured to engage the frame of the building and/or to be engaged by an aerial lifting machine.

11. The apparatus of claim 1, wherein said girt support assembly comprises a pipe attachment means for moveably attaching said bracket to said support pipe so as to adjust the position of said bracket on said support pipe.

12. An apparatus for leveling and supporting a wind girt in a span between posts of a frame of a building, said apparatus comprising:

a support pipe having an elongated pipe body defining an upper end and a lower end of said support pipe and a pipe axis between said lower end and said upper end thereof, said support pipe comprising at least a first pipe member and a second pipe member said first pipe member and said second pipe member being telescopically configured to adjust the length of said support pipe;

a base assembly at said lower end of said support pipe, said base assembly having a footplate that is structured and arranged to support said support pipe in an upright position on a support surface at or adjacent the span between the posts, said base assembly further comprising one or more curved shaft members and an inner shaft member, said one or more curved shaft members disposed between said footplate and said lower end of said support pipe, said inner shaft member positioned above said one or more curved shaft members and disposed inside said lower end of said support pipe to allow said support pipe to move upward and downward relative to said base assembly;

a lever assembly operatively interconnecting said support pipe and said base assembly so as to move said support pipe upward relative to said base assembly when said lever assembly is moved to an extended position and to move said support pipe downward toward said base assembly when said lever assembly is moved to a retracted position; and a girt support assembly having a bracket moveably attached to said support pipe so as to move upward and downward with upward and downward movement of said support pipe, said bracket extending outward from said support pipe so as to engage the wind girt when said lever assembly is moved to said extended position so as to move the wind girt from a sagging condition to a level condition.

13. The apparatus of claim 12, wherein said support pipe further comprises a length adjusting means cooperatively configured with said first pipe member and said second pipe member for adjusting the length of said support pipe, said length adjusting means having one or more clamping devices that are configured to fix the length of said support pipe.

14. The apparatus of claim 12, wherein said lever assembly has one or more upper lever members pivotally connected to said support pipe, one or more lower lever members pivotally connected to said base assembly and a handle connected to at least one of said one or more upper lever members, said upper lever members and said lower lever members being pivotally connected to each other to allow said lever assembly to move between said retracted position and said extended position.

15. A method of leveling and supporting a wind girt disposed in a span between posts of a frame of a building, said method comprising the steps of:

(a) providing a girt alignment apparatus having a telescopically configured elongated support pipe with a lower end and an upper end, a base assembly at said lower end of said support pipe, a lever assembly operatively interconnecting said support pipe and said base assembly so as to move said support pipe upward and downward, and a girt support assembly moveably secured to said support pipe so as to move upward and downward with said support pipe, said girt support assembly extending outwardly from said support pipe so as to engage the wind girt to move the wind girt from a sagging condition to a level condition;

(b) adjusting the support pipe to have sufficient height to extend said upper end thereof upward to at or above the wind girt and securing said girt support assembly on said support pipe at a position thereon so said girt support assembly will be below the wind girt in the sagging condition when said lever assembly is in a retracted position and engaging the wind girt when said lever assembly is in an extended position;

(c) standing said apparatus in an upright position at the span with said base assembly on a support surface and said girt support assembly positioned below the wind girt in the sagging condition with said lever assembly being in said retracted position;

(d) moving said lever assembly to said extended position to raise said support pipe and said girt support assembly upward to engage the wind girt and move the wind girt to said level condition;

(e) attaching a plurality of panels and/or one or more panelized sections to the wind girts to form a wall of the building; and (f) operating said lever assembly to place said lever assembly in said retracted position to move said support pipe and said girt support assembly downward to disengage from the wind girt.

16. The method of claim 15, wherein said apparatus further comprises a safety chain and said method further comprises the step of securing said safety chain to the frame of the building prior to said lever assembly moving step and/or the step of moving said apparatus away from the span with said safety chain after said moving step.

17. A method of leveling and supporting a wind girt disposed in a span between posts of a frame of a building, said method comprising the steps of:

(a) providing a girt alignment apparatus having a telescopically configured elongated support pipe with a lower end and an upper end, a base assembly at said lower end of said support pipe, a lever assembly operatively interconnecting said support pipe and said base assembly so as to move said support pipe upward and downward, a girt support assembly moveably secured to said support pipe so as to move upward and downward with said support pipe and a safety chain, said girt support assembly extending outwardly from said support pipe so as to engage the wind girt to move the wind girt from a sagging condition to a level condition;

(b) adjusting the support pipe to have sufficient height to extend said upper end thereof upward to at or above the wind girt and securing said girt support assembly on said support pipe at a position thereon so said girt support assembly will be below the wind girt in the sagging condition when said lever assembly is in a retracted position and engaging the wind girt when said lever assembly is in an extended position;

(c) standing said apparatus in an upright position at the span with said base assembly on a support surface and said girt support assembly positioned below the wind girt in the sagging condition with said lever assembly being in said retracted position;

(d) securing said safety chain to the frame of the building;

(e) moving said lever assembly to said extended position to raise said support pipe and said girt support assembly upward to engage the wind girt and move the wind girt to said level condition; and (f) moving said apparatus away from the span with said safety chain.

* * * * *